US005356185A

United States Patent [19]

Cameron

[11] Patent Number: 5,356,185

[45] Date of Patent: Oct. 18, 1994

[54] SLIDING PANEL LOCK

[76] Inventor: Russell S. Cameron, 18012 Manhattan Pl., Torrance, Calif. 90504

[21] Appl. No.: 47,992

[22] Filed: Apr. 19, 1993

[51] Int. Cl.[5] ..... E05C 1/04

[52] U.S. Cl. ..... 292/149; 49/449; 49/450; 292/DIG. 46; 292/137

[58] Field of Search ..... 292/149, 137, DIG. 46; 49/449, 450

[56] References Cited

U.S. PATENT DOCUMENTS

| | | | |
|---|---|---|---|
| 452,776 | 5/1891 | Doty | 292/149 X |
| 2,721,361 | 10/1955 | Ryan et al. | 292/DIG. 46 X |
| 3,471,189 | 10/1969 | Ness | 49/449 X |
| 3,768,847 | 10/1973 | Buck, Jr. et al. | 292/DIG. 46 X |
| 3,791,683 | 2/1974 | Bright | 292/149 X |
| 3,807,779 | 4/1974 | Enders | 292/DIG. 46 X |
| 4,045,982 | 9/1977 | Gorton et al. | 49/449 X |
| 4,792,168 | 12/1988 | Kardosh | 292/DIG. 46 X |

*Primary Examiner*—Philip C. Kannan
*Attorney, Agent, or Firm*—Roger A. Marrs

[57] ABSTRACT

A lock is disclosed herein for sliding panels such as doors or windows, which prevents the panel from being moved or removed from its mounting rail or slide. In one version, the lock includes a base mount secured to the rail or slide having a laterally movable pin latch member adapted to be inserted through an opening in the frame of the panel. The pin or latch member includes a key at its tip receivable through an indexed slot of the opening so that when turned, the pin is prevented from being withdrawn. A retaining screw selectively holds the pin to the mount. The other version includes an elongated sleeve fixed to a sill and having an open-ended bore for insertably receiving a rod carried on the panel frame. The rod has a plurality of spaced-apart grooves for receiving the end of a retaining pin threadably carried on the sleeve to prevent removal of the rod from the sleeve.

2 Claims, 2 Drawing Sheets

SLIDING PANEL LOCK

BACKGROUND OF THE INVENTION

1. Field of the Invention

The present invention relates to the field of sliding panel locks, and more particularly to a novel lock useful to prevent removal of doors or windows from their slide mounts and which will prevent sliding of the panels to the left or right once the lock has been set.

2. Brief Description of the Prior Art

In the past, problems and difficulties have been encountered with locks for sliding doors or windows which stem from the fact that the locks prevent limited movement of the door or window panel. In some instances, the panel is prevented from movement in only one direction and in other instances, although the lock has been set, the entire window or door frame may be removed in order to gain unauthorized entry into a room or dwelling. In other instances, the panel lock may only be used on panels which are inwardly set in the frame as opposed to sliding mountings on the outside of the mounting frame.

Therefore, a long-standing need has existed to provide a novel lock for door window sliding panels which is simple to operate and which will prevent unauthorized access into a dwelling by reverse sliding of the panel or by removal of the panel from the frame.

SUMMARY OF THE INVENTION

Accordingly, the above problems and difficulties are avoided by the present invention which provides a novel lock usable in connection with sliding door or window panels wherein in one form, the lock comprises a fixed mount having a laterally movable pin carrying a key on its tip that is registerable with a slotted opening in the panel frame. When properly aligned, the keyed pin is inserted through the slotted opening and rotated so as to restrict withdrawal of the pin from the frame and which will prevent movement of the frame in either a right or left direction as well as preventing upward movement of the frame so as to prevent removal from the sliding track or mount. A retaining fastener is carried on the fixed mount for selective engagement with the pin to prevent the pin from being withdrawn from the slotted opening and to prevent rotation of the pin once the lock has been set. In another version, an elongated open-ended sleeve is carried on the track or sill of a window and an elongated rod is carried on the frame of the panel and is insertably received within the open-ended bore of the sleeve. A retaining fastener is carried on the sleeve for engagement with a selected one of a polarity of grooves in the rod. In either version, once the lock has been set, removal or movement of the panel is restricted and prevented.

Therefore, it is among the primary objects of the present invention to provide a novel lock for sliding panels which restricts movement of the panel in all orientations once the lock has been set.

Another object of the present invention is to provide a novel lock for a sliding door or window which may be employed to lock the door or window panel in position at a selected location along its sliding track so that the panel can no longer be moved until released by the user.

Still a further object of the present invention is to provide a novel window or door lock for a sliding panel which restricts the movement of the panel in all of its orientations which includes right and left movement as well as up and down movement so that the panel is retained in place and in position pending release by the user.

Still a further object of the present invention is to provide a door or window lock which is relatively inexpensive and which may be installed by a person without special skills and special tools, and which will hold a sliding panel in a selected position until released by the user.

BRIEF DESCRIPTION OF THE DRAWINGS

The features of the present invention which are believed to be novel are set forth with particularity in the appended claims. The present invention, both as to its organization and manner of operation, together with further objects and advantages thereof, may best be understood with reference to the following description, taken in connection with the accompanying drawings in which:

DESCRIPTION OF THE PREFERRED EMBODIMENT

Figure 1:
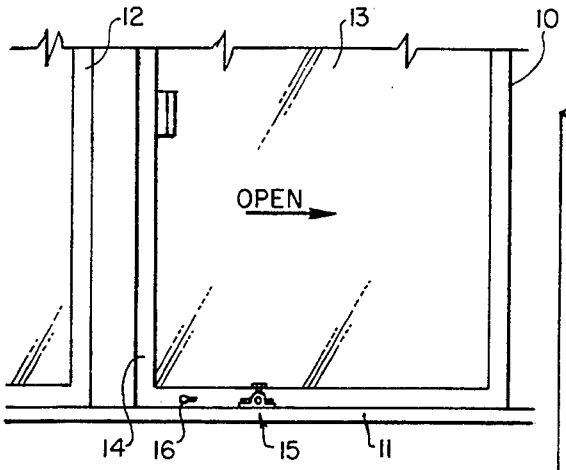
FIG. 1 is a front elevational view of a typical sliding panel such as a door held in a selected position by the novel lock incorporating the present invention.

Referring to FIG. 1, a sliding panel is indicated by numeral 10 which is mounted on a track or slide 11 so as to move along the track when pushed by the user. Numeral 12 indicates a stationary door which is also mounted on the track 11 and the sliding door or panel 10 moves back and forth from the stationary door 12. The panel 10 generally includes a centrally mounted glass, indicated by numeral 13, which is carried about its peripheral edges by a metal frame 14. The novel lock of the present invention is illustrated in the direction of arrow 15 and the lock is used in connection with a selected one of a plurality of slotted openings, as indicated by numeral 16.

Figure 2:
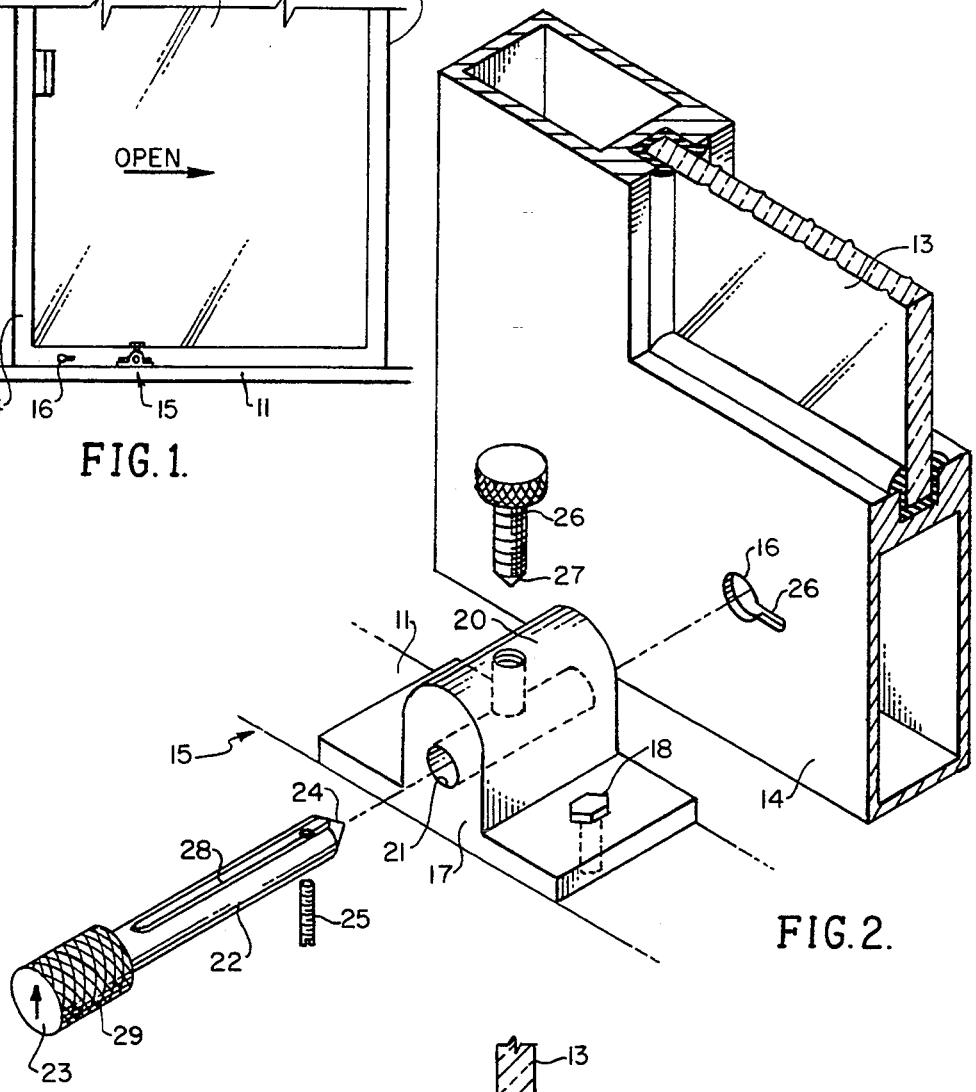
FIG. 2 is an enlarged exploded view illustrating the novel lock of the present invention as used in the illustration of FIG. 1.

Referring now in detail to FIG. 2, the novel lock of the present invention as illustrated in the direction of arrow 15 includes a fixed mount or base 17 which is secured to the sill or track 11 by means of fasteners, such as fastener 18. The base 17 includes a central portion 20 which is provided with an open-ended bore 21 for insertably receiving a shank 22 of a member or pin 23. The pin is provided with a knurled enlarged end 29 suitable for grasping by the fingers of the user so that the shank may be slid through the bore 21 so that its end 29 projects through the slotted opening 16. A key 25 taking the form of a threaded set screw is carried on the end of the pin shank 22 so as to partially project from the shank. The key 25 is deployed on the opposite side of the mount portion 20 from the enlarged knurled portion 29 so that the user may index or align the key 25 with a slot 26 associated with the opening 16. Once the key 25 and shank 22 have been inserted into the slotted opening 16, the shank is rotated so that the key 25 bears against the inside of the frame 14. Such a position is shown more clearly in FIG. 3. Once this has been achieved, a retaining fastener is indicated by numeral 26 and this fastener includes a pointed end 27 which when screwed into the mount portion 20, resides into an elongated groove or notch 28 in the shank 22. The retaining fastener 26 prevents the pin 23 from rotating and prevents the key 25 from inadvertently being placed in slot 26 which would effect removal.

Figure 3:
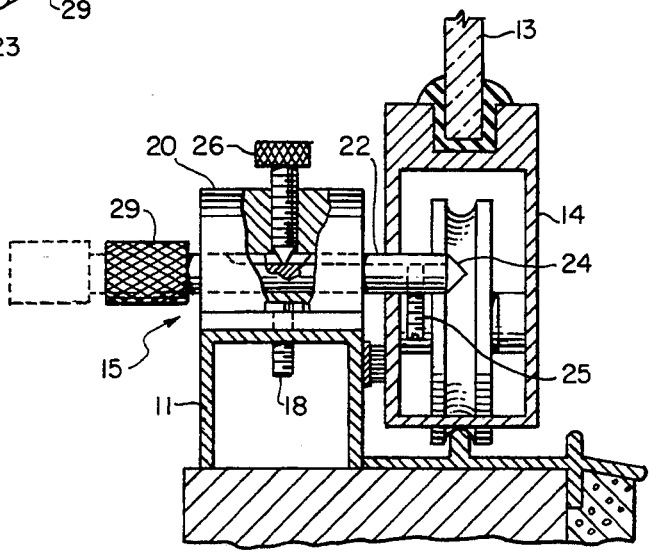
FIG. 3 is a transverse cross-sectional view of the sliding panel and the novel lock as shown in FIG. 2.

Therefore, it can be seen that the lock illustrated in FIGS. 2 and 3 not only prevents the panel from sliding right or left but prevents removal of the panel from its mounting track or rail in a vertical direction. Also, it can be seen that once the retainer fastener 26 has been set, the pin 23 cannot be removed since rotation is prohibited.

Figure 4:
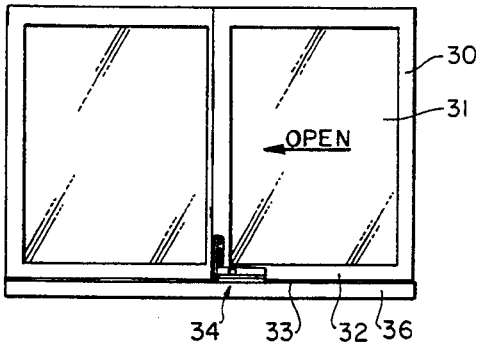
FIG. 4 is a view similar to the view of FIG. 1 illustrating a sliding window panel.

Referring now in detail to FIG. 4, another embodiment of the present is illustrated in connection with a panel consituting a window, as identified by numeral 30. The window 30 incorporates a glass pane 31 which is carried about its peripheral edges in a frame 32 that is slidably seated on a track 33 shown more clearly in FIG. 6. The novel lock is indicated in the general direction of arrow 34 and is more clearly shown in FIGS. 5 and 6.

Figure 5:
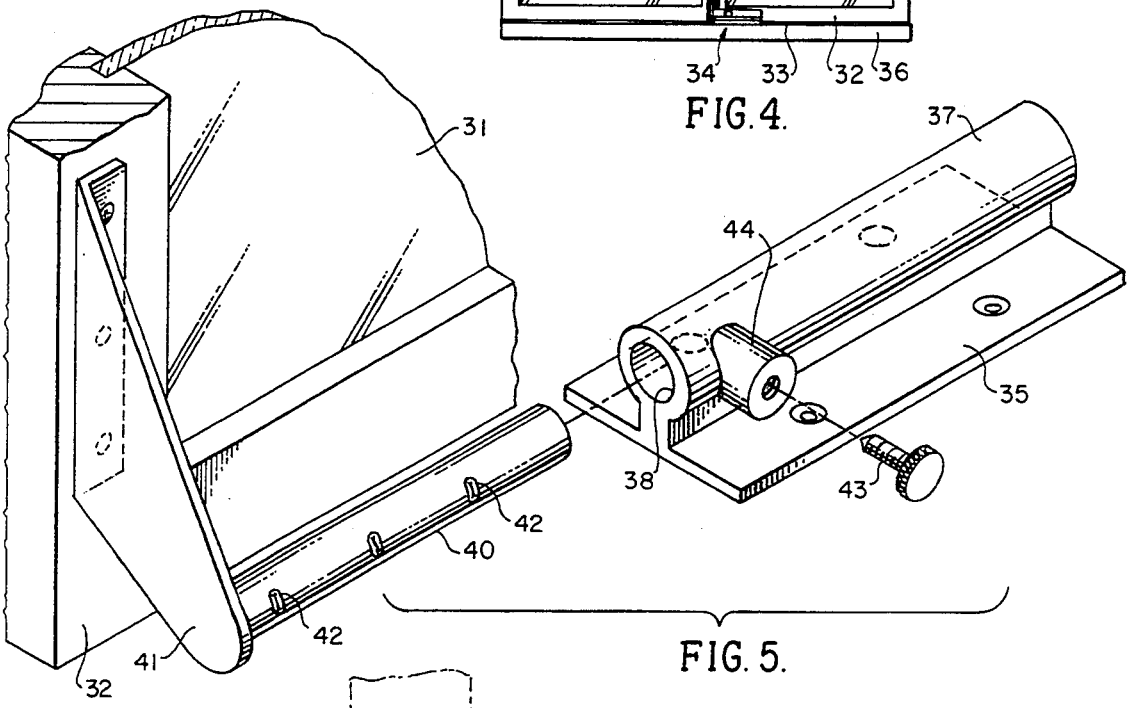
FIG. 5 is an exploded view of another version of the novel lock used in connection with the sliding window panel of FIG. 4.
Figure 6:
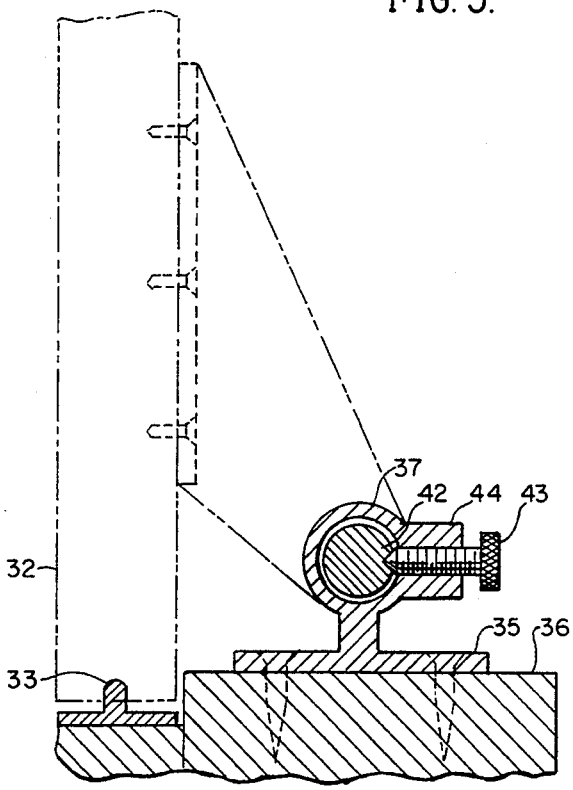
FIG. 6 is a transverse cross-sectional view of the novel lock shown in FIGS. 4 and 5.

With respect to FIG. 5, it can be seen that the lock includes a mount or base 35 that is carried on a conventional windowsill 36 by means of suitable screw fasteners. The base 35 includes an elongated sleeve 37 having an open-ended bore 38 into which an elongated rod 40 is slidably received. One end of the rod is securely attached to a bracket 41 that, in turn, is fixedly secured to the frame 32 of the panel. The opposite end of the rod 40 is insertably received within the open end of bore 38. The rod 40 is provided with a plurality of spaced-apart grooves, such as groove 42. A retaining fastener 43 is threadably carried on the sleeve 37 through a portion 44 so that the free end of the fastener engages within a selected one of the grooves. It is to be noted particularly in FIG. 6 that the groove 42 is elongated and arcuate in order to accommodate for any misalignment of the sill mounted mount or base 35 and the panel or track 33.

Therefore, the user may slide the panel 30 to an open or closed position so as to align the retainer screw or fastener 43 with a selected one of the grooves 42. At the selection, the retaining fastener is then advanced so that its end or tip will engage the rod 40 within the selected groove. The window or panel is then prevented from being moved to the left or right and is also prevented from being totally removed from its mounting on the sill.

While particular embodiments of the present invention have been shown and described, it will be obvious to those skilled in the art that changes and modifications may be made without departing from this invention in its broader aspects and, therefore, the aim in the appended claims is to cover all such changes and modifications as fall within the true spirit and scope of this invention.

What is claimed is:

1. A releasable locking means for a sliding panel comprising:

a stationary base;

a sliding panel having an aperture opening towards said stationary base;

a movable latch member slidably carried on aid stationary base and having an end adapted to register with said aperture for insertable reception therethrough;

retainer means threadably carried on said stationary base normal to said latch member for selectively engaging with said latch member to releasably retain said latch member in position within said sliding panel aperture;

said aperture is a slotted hole and said latch member includes an outwardly projecting key from said latch member end and being matable with said slotted hole to be inserted therethrough and rotated to engage said key with said panel; and said latch member includes a groove parallel to the central longitudinal axis of said latch member for insertably receiving said retainer means.

2. A releasable locking means for a sliding panel comprising:

a stationary base having an open sleeve;

a sliding panel having an elongated rod provided with at least one aperture opening towards said stationary base;

said rod slideably disposed in said sleeve;

a movable latch member threadably carried on said sleeve and having an end adapted to register with said aperture for insertable reception therethrough;

said at least one aperture constituting an arcuate groove for receiving said latch member;

retainer means carried on said latch member for selectively engaging with said groove to releasably retain said latch member in position within said groove; and said retainer means further including a conical shaped tip provided on said latch member insertably receivable within a conical depression provided in said groove.

* * * * *